US010934033B2

(12) United States Patent
Ichikawa et al.

(10) Patent No.: US 10,934,033 B2
(45) Date of Patent: Mar. 2, 2021

(54) BAG-MAKING AND PACKAGING APPARATUS

(71) Applicant: ISHIDA CO., LTD., Kyoto (JP)

(72) Inventors: Makoto Ichikawa, Ritto (JP); Toru Morihira, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 107 days.

(21) Appl. No.: 16/168,830

(22) Filed: Oct. 24, 2018

(65) Prior Publication Data

US 2019/0127092 A1 May 2, 2019

(30) Foreign Application Priority Data

Nov. 1, 2017 (JP) ..... JP2017-212149

(51) Int. Cl.
*B65B 9/207* (2012.01)
*B65B 57/08* (2006.01)
(Continued)

(52) U.S. Cl.
CPC ..... *B65B 9/207* (2013.01); *B65B 51/306* (2013.01); *B65B 57/08* (2013.01); *B65B 57/10* (2013.01);
(Continued)

(58) Field of Classification Search
CPC ..... B65B 9/207; B65B 9/20; B65B 9/2028; B65B 9/2042; B65B 9/213; B65B 51/306;
(Continued)

(56) References Cited

U.S. PATENT DOCUMENTS 4,546,596 A * 10/1985 Cherney ..... B29C 66/874 156/358
4,563,862 A * 1/1986 McElvy ..... B29C 66/8491 53/552
(Continued)

FOREIGN PATENT DOCUMENTS

EP 0959397 A2 11/1999
EP 0974518 A1 1/2000
(Continued)

OTHER PUBLICATIONS

The Examination report No. 1 from the corresponding Patent Application in the Australia No. 2018253503 dated Feb. 18, 2019.
(Continued)

*Primary Examiner* — Dariush Seif
(74) *Attorney, Agent, or Firm* — Shinjyu Global IP

(57) ABSTRACT

A bag-making and packaging apparatus creates one product per cycle by packaging articles in a bag made from a film. The bag-making and packaging apparatus includes a longitudinal sealing mechanism, a guide, an article sensor, a transverse sealing mechanism, a cutting mechanism, and a prediction unit. The guide guides the articles which fall from above into a film tube. The transverse sealing mechanism forms a transversely sealed part in the film tube with each cycle. The cutting mechanism cuts the film tube in the transversely sealed part with each cycle. The prediction unit predicts whether or not jamming of the articles could occur in the transverse sealing mechanism on the basis of an output of the article sensor with each cycle. When the prediction unit has predicted that the jamming could occur in a certain cycle, the cutting mechanism does not cut the film tube in the certain cycle.

6 Claims, 11 Drawing Sheets

(51) Int. Cl.

| | |
|---|---|
| ***B65B 57/18*** | (2006.01) |
| ***B65B 57/10*** | (2006.01) |
| ***B65B 57/16*** | (2006.01) |
| ***B65B 51/30*** | (2006.01) |
| ***B65B 61/06*** | (2006.01) |
| ***B65B 9/20*** | (2012.01) |
| ***B65B 1/32*** | (2006.01) |
| ***B65B 9/213*** | (2012.01) |

(52) U.S. Cl.
CPC ..... *B65B 57/16* (2013.01); *B65B 57/18* (2013.01); *B65B 61/06* (2013.01); *B65B 1/32* (2013.01); *B65B 9/20* (2013.01); *B65B 9/2028* (2013.01); *B65B 9/2042* (2013.01); *B65B 9/213* (2013.01); *B65B 51/30* (2013.01)

(58) Field of Classification Search
CPC ..... B65B 51/30; B65B 57/08; B65B 57/10; B65B 57/16; B65B 57/18; B65B 61/06; B65B 1/32
USPC ..... 53/52, 450, 547, 551, 451, 54
See application file for complete search history.

(56) References Cited

U.S. PATENT DOCUMENTS 4,574,566 A * 3/1986 Eaves ..... B65B 9/067 53/450
4,757,668 A * 7/1988 Klinkel ..... B29C 65/02 53/374.6
4,768,327 A * 9/1988 Mosher ..... B29C 66/8491 53/451
4,800,707 A * 1/1989 Rabus ..... B65B 9/2028 53/552
4,974,396 A * 12/1990 Gaukler ..... B65B 9/2028 493/197
5,125,213 A * 6/1992 Focke ..... B65B 1/22 53/437
5,473,866 A * 12/1995 Maglecic ..... B65B 1/22 53/151
5,540,035 A * 7/1996 Plahm ..... B29C 66/49 53/451
5,870,887 A * 2/1999 Bennett ..... B29C 66/8161 53/551
6,116,314 A * 9/2000 Johnson ..... B32B 5/04 156/363
6,119,438 A * 9/2000 Bacon ..... B65B 9/20 53/451
6,138,442 A * 10/2000 Howard ..... B65B 51/30 53/373.7
6,367,230 B1 * 4/2002 Fukuda ..... B29C 65/18 53/451
6,373,001 B1 * 4/2002 Kono ..... G01G 15/00 177/25.18
6,421,981 B1 * 7/2002 Nakagawa ..... B65B 51/306 53/58
6,427,422 B2 * 8/2002 Nakagawa ..... B65B 1/22 53/437
6,460,312 B1 * 10/2002 Nakagawa ..... B65B 9/20 53/493
6,711,874 B1 * 3/2004 Nakagawa ..... B29C 65/02 53/502
6,945,008 B2 * 9/2005 Nakagawa ..... B65B 9/20 53/52
7,121,067 B1 * 10/2006 Fukuda ..... B29C 66/9241 53/551
10,287,046 B2 * 5/2019 Kiyota ..... B29C 66/849
2002/0002810 A1 * 1/2002 Nakagawa ..... B65B 1/22 53/437
2002/0035822 A1 * 3/2002 Nakagawa ..... B65B 51/306 53/493
2002/0121076 A1 * 9/2002 Nakagawa ..... B65B 51/306 53/493
2003/0000179 A1 * 1/2003 Nakagawa ..... B65B 9/2028 53/493
2012/0204515 A1 * 8/2012 Miyamoto ..... B65B 1/22 53/266.1
2013/0059709 A1 * 3/2013 Miyamoto ..... B65B 1/22 493/186
2015/0298833 A1 * 10/2015 Pedersen ..... B29C 65/7451 53/450
2016/0194100 A1 * 7/2016 Yasuda ..... B29C 66/8242 53/551
2018/0346159 A1 * 12/2018 Ichikawa ..... B65B 9/2007
2018/0354661 A1 * 12/2018 Koike ..... B65B 51/30

FOREIGN PATENT DOCUMENTS

| | | | |
|---|---|---|---|
| JP | 2003-072720 | A | 3/2003 |
| JP | 2009-227288 | A | 10/2009 |
| WO | 2017/094342 | A1 | 6/2017 |

OTHER PUBLICATIONS

The Search Report from the corresponding European Patent Application No. 18203416.5 dated Apr. 1, 2019.

* cited by examiner

BAG-MAKING AND PACKAGING APPARATUS

CROSS-REFERENCES TO RELATED APPLICATIONS

This application claims priority to Japanese Patent Application No. 2017-212149 filed on Nov. 1, 2017. The entire disclosure of that application is hereby incorporated by reference.

TECHNICAL FIELD

The present disclosure relates to a bag-making and packaging apparatus.

BACKGROUND ART

With each operation cycle, a bag-making and packaging apparatus receives articles that fall from a weighing machine and packages the articles in a film. Specifically, the bag-making and packaging apparatus performs a longitudinal sealing step of fashioning the film into tube form. The bag-making and packaging apparatus then performs a transverse sealing step of fashioning the tubular film into bag form. The transverse sealing step is performed by sealing jaws.

When articles falling from the weighing machine reach the sealing jaws at an inappropriate time, "jamming" occurs, in which articles are caught in a transversely sealed part of the film. In the bag-making and packaging apparatus of Patent Literature 1 (Japanese Laid-open Patent Publication No. 2003-72720), the time at which articles reach the transverse sealing jaws is determined by calculation, and the time of the transverse sealing step in that cycle is shifted. However, the time at which articles reach the sealing jaws sometimes changes irregularly due to various causes, and therefore, some degree of jamming might be inevitable.

BRIEF SUMMARY

Jamming causes defectives. Another negative effect of jamming is that articles get thrown out of the film from the transversely sealed part where the jamming has occurred. In such instances, the articles adhere to the sealing jaws or to properly packaged products. As a result, this causes operational faults in the transverse sealing operation or fouling of the products.

An object of the present disclosure is to reduce inconveniences caused by jamming in a bag-making and packaging apparatus.

Solution to Problem

A bag-making and packaging apparatus according to a first aspect of the present disclosure creates one product per cycle by packaging articles in a bag made from a film. The bag-making and packaging apparatus comprises a longitudinal sealing mechanism, a guide, an article sensor, a transverse sealing mechanism, a cutting mechanism, and a prediction unit. The longitudinal sealing mechanism forms a film tube from the film. The guide guides the articles falling from above into the film tube. The article sensor senses the articles falling from above. The transverse sealing mechanism forms a transversely sealed part in the film tube with each cycle. The cutting mechanism cuts the film tube in the transversely sealed part with each cycle. The prediction unit predicts whether or not jamming of the articles could occur in the transverse sealing mechanism on the basis of an output of the article sensor with each cycle. When the prediction unit has predicted that the jamming could occur in a certain cycle, the cutting mechanism does not cut the film tube in the certain cycle.

With this configuration, the cutting mechanism does not cut the film tube in a cycle in which jamming could occur. Therefore, instances in which articles come out from the cut spot of the film tube are minimized.

A bag-making and packaging apparatus according to a second aspect of the present disclosure is the bag-making and packaging apparatus according to the first aspect, wherein when the prediction unit has predicted that the jamming could occur in a certain cycle, the transverse sealing mechanism does not form the transversely sealed part in the certain cycle.

With this configuration, the transverse sealing mechanism does not form the transversely sealed part in the film tube in a cycle in which jamming could occur. Therefore, damage to the film by the transverse sealing operation is minimized, and instances of the articles coming out from the film tube are minimized.

A bag-making and packaging apparatus according to a third aspect of the present disclosure is the bag-making and packaging apparatus according to the first or second aspect, further comprising a setting storage unit. The setting storage unit stores an offset time beginning at the starting point of the cycle and a permission time beginning at the ending point of the offset time. A sum of the offset time and the permission time is shorter than the cycle. When the article sensor detects the articles outside of the permission time, the prediction unit predicts that the jamming could occur.

With this configuration, when the articles are detected outside of the permission time, the prediction unit predicts that the jamming could occur. Therefore, the possibility of the jamming is assessed by a simple configuration involving the use of the article sensor.

A bag-making and packaging apparatus according to a fourth aspect of the present disclosure is the bag-making and packaging apparatus according to the third aspect, further comprising a processing unit and a jamming sensing unit that senses an occurrence of the jamming. When the jamming sensing unit does not sense an occurrence of the jamming, the processing unit updates the permission time stored by the setting storage unit to a longer time.

With this configuration, when the jamming sensing unit does not actually sense the jamming, the permission time is extended. Therefore, the permission time is automatically optimized.

A bag-making and packaging apparatus according to a fifth aspect of the present disclosure is the bag-making and packaging apparatus according to any one of the first through fourth aspects, further comprising a warning unit. The warning unit issues a warning when the jamming has occurred at least a predetermined number of times within a predetermined time duration.

With this configuration, a warning is issued when the frequency of jamming occurrences is high. Therefore, a user has the opportunity to reexamine the set value of the permission time.

A bag-making and packaging apparatus according to a sixth aspect of the present disclosure is the bag-making and packaging apparatus according to any one of the first through fifth aspects, wherein the length of the bag of the product is a first length. When the prediction unit has predicted that the jamming could occur, the bag having a second length greater than the first length is created due to the cutting mechanism not cutting the film tube.

With this configuration, when the jamming could occur, the bag-making and packaging apparatus creates a bag having a length greater than the length of the product. Therefore, it is easy to identify an unsatisfactory product in which the jamming could have occurred.

The bag-making and packaging apparatus according to the present advancement reduces inconvenience caused by jamming.

DETAILED DESCRIPTION OF EMBODIMENTS

Below is a description, made with use of the drawings, of an embodiment of a bag-making and packaging apparatus according to the present disclosure. The specific configuration of the bag-making and packaging apparatus according to the present advancement is not limited to the following embodiment, and can be altered as appropriate within a range that does not deviate from the scope of the advancement.

(1) Overall Configuration

Figure 1:
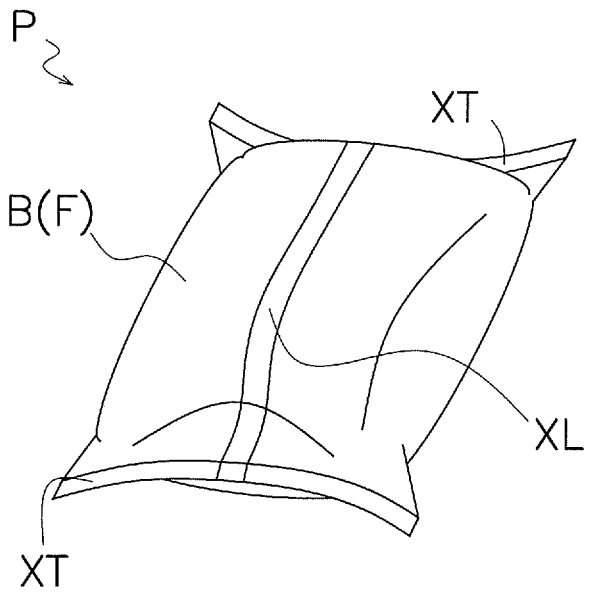
FIG. 1 is a schematic drawing showing a product P manufactured by a bag-making and packaging apparatus 20 according to the present disclosure.

FIG. 1 shows a product P manufactured by a bag-making and packaging apparatus according to the present disclosure. The product P is articles packaged by a bag B made from a film F. A longitudinally sealed part XL and a transversely sealed part XT are formed in the bag B.

Figure 2:
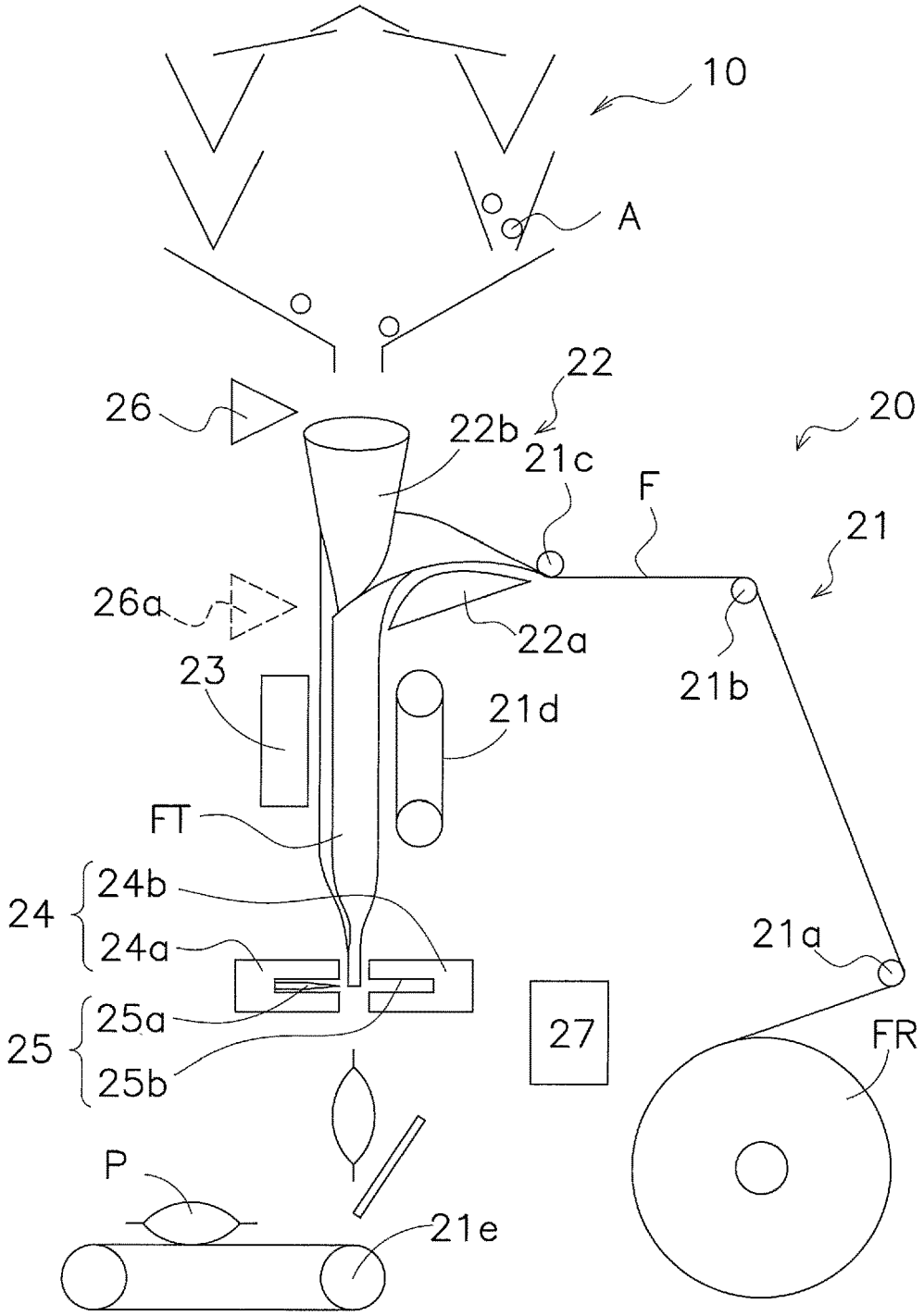
FIG. 2 is a schematic drawing showing the configuration of the bag-making and packaging apparatus 20.

The bag-making and packaging apparatus 20 according to the present advancement is installed below a weighing machine 10, as shown in FIG. 2. The weighing machine 10 drops articles A in predetermined weights into the bag-making and packaging apparatus 20. The bag-making and packaging apparatus 20 receives the articles A and manufactures a product P by packaging the articles A in a film F. In one operation cycle of the bag-making and packaging apparatus 20, one product P is manufactured.

(2) Detailed Configuration

The bag-making and packaging apparatus 20 has a conveying mechanism 21, a film-shaping mechanism 22, a longitudinal sealing mechanism 23, a transverse sealing mechanism 24, a cutting mechanism 25, an article sensor 26, and a processing unit 27, as shown in FIG. 2.

(2-1) Conveying Mechanism 21

The conveying mechanism 21 conveys the film F extracted from a film roll FR, and the products P. The conveying mechanism 21 has rollers 21*a*, 21*b*, 21*c*, a pull-down belt 21*d*, and a conveyor belt 21*e*.

(2-2) Film-Shaping Mechanism 22

The film-shaping mechanism 22 rounds the flat film F into the form of a tube. The film-shaping mechanism 22 has a former 22*a* and a tube 22*b*. The former 22*a* deforms the flat film F so that the film encircles the tube 22*b*.

(2-3) Longitudinal Sealing Mechanism 23

The longitudinal sealing mechanism 23 forms a film tube FT from the film F. The film tube FT has a longitudinally sealed part XL. The longitudinal sealing mechanism 23 has a heater, and temporarily softens two longitudinal edges of the film F. The two softened longitudinal edges bond together, forming the longitudinally sealed part XL. The tube 22*b* of the film-shaping mechanism 22 functions as a guide that guides articles A falling from above to the inside of the film tube FT.

(2-4) Transverse Sealing Mechanism 24

With each cycle, the transverse sealing mechanism 24 forms one transversely sealed part XT in the film tube FT. The transverse sealing mechanism 24 has a first sealing jaw 24*a* and a second sealing jaw 24*b*. The first sealing jaw 24*a* and the second sealing jaw 24*b* both have a heater, and temporarily soften part of the film tube FT. The softened parts bond together, forming a transversely sealed part XT.

(2-5) Cutting Mechanism 25

With each cycle, the cutting mechanism 25 cuts the film tube FT at the transversely sealed part XT. The cutting mechanism 25 is provided to the transverse sealing mechanism 24. The cutting mechanism 25 includes a knife 25*a* and a receiving part 25*b*. The knife 25*a* is provided to the first sealing jaw 24*a*. The receiving part 25*b* is provided to the second sealing jaw 24*b*. The knife 25*a* can extend and retract. When extended, the knife 25*a* is accommodated in the receiving part 25*b*.

(2-6) Article Sensor 26

The article sensor 26 senses the articles A falling from above. The article sensor 26 is, for example, an optical sensor, but this example is not provided by way of limitation. The location where the article sensor 26 is attached is, for example, above the tube 22*b* and below the weighing machine 10, but this example of a location is not provided by way of limitation.

For example, the article sensor 26 can be provided to a spot 26*a* where the film F encircles the tube 22*b*. In this case, an opening is provided in the tube 22*b* at a location adjacent to the spot 26*a*. Light emitted from a light projector of an optical sensor of the article sensor 26 permeates through the film F and then passes through the opening of the tube 22*b* to be radiated onto the articles A.

(2-7) Processing Unit 27

Figure 3:
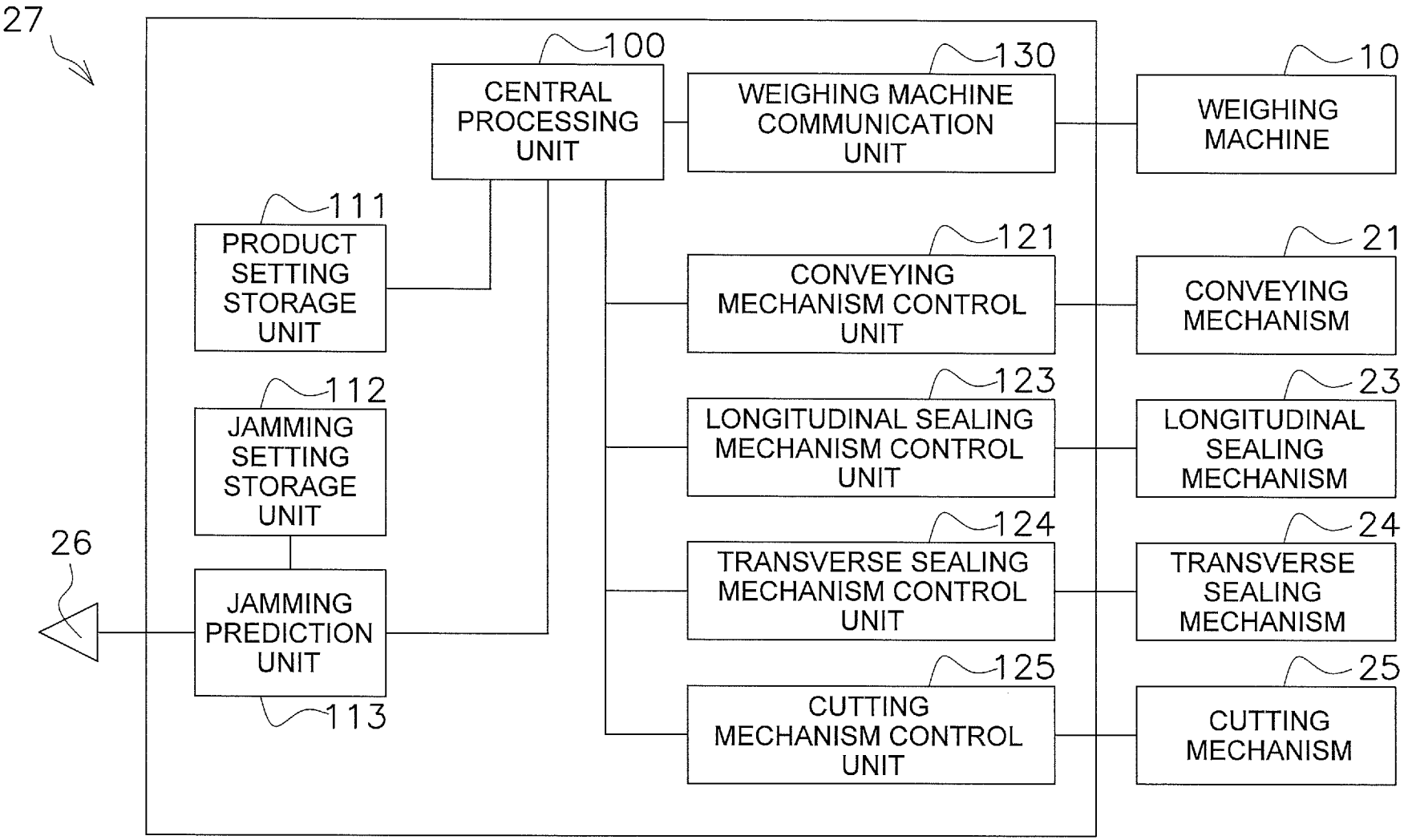
FIG. 3 is a block diagram of a processing unit 27.

The processing unit 27 coordinates the operations of the bag-making and packaging apparatus 20. The processing unit 27 is a computer including a CPU and a storage device. FIG. 3 shows the configuration of the processing unit 27. The processing unit 27 has a central processing unit 100, a product setting storage unit 111, a jamming setting storage unit 112, a jamming prediction unit 113, a conveying mechanism control unit 121, a longitudinal sealing mechanism control unit 123, a transverse sealing mechanism control unit 124, a cutting mechanism control unit 125, and a weighing machine communication unit 130.

The central processing unit 100 performs various calculations and controls. The product setting storage unit 111 stores the sizes of bags B for products P that are to be manufactured, the types of films F, and other settings. The jamming setting storage unit 112 stores settings pertaining to article A fall timings that are regarded as normal or abnormal. With each cycle, the jamming prediction unit 113 compares an output signal of the article sensor 26 with a setting stored in the jamming setting storage unit 112, and predicts whether or not jamming could occur in that cycle of the bag-making and packaging apparatus. The conveying mechanism control unit 121, the longitudinal sealing mechanism control unit 123, the transverse sealing mechanism control unit 124, and the cutting mechanism control unit 125 respectively control the conveying mechanism 21, the longitudinal sealing mechanism 23, the transverse sealing mechanism 24, and the cutting mechanism 25. The weighing machine communication unit 130 conducts communication with the weighing machine 10.

(3) Film F

Figure 4:
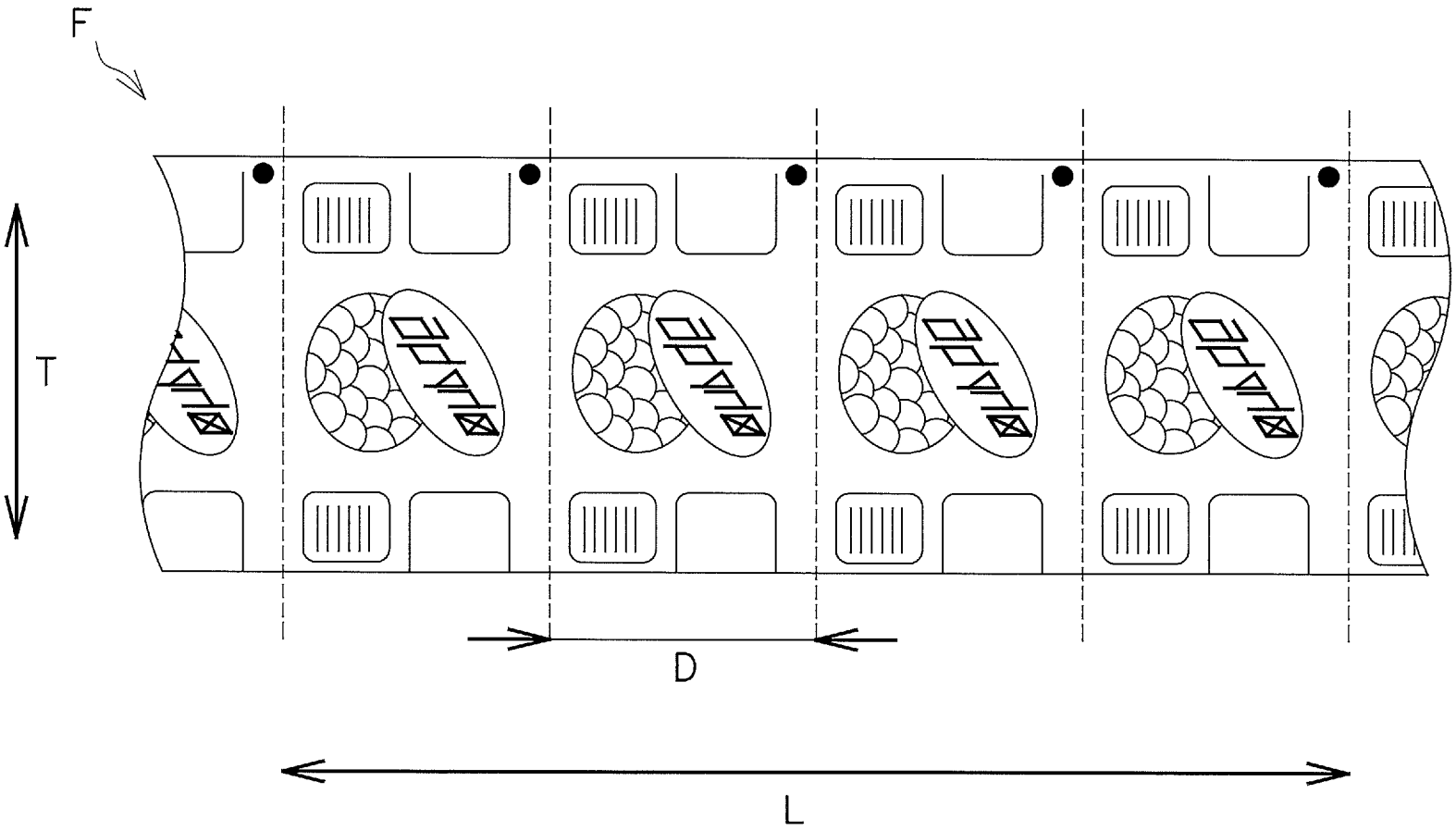
FIG. 4 is a schematic drawing showing a film F.

FIG. 4 shows the film F used in the packaging of the articles A. The film F extends in a longitudinal direction L, and has a constant width along a transverse direction T perpendicular to the longitudinal direction L. A design corresponding to packaging of one product P is printed at each distance of length D.

Figure 5:
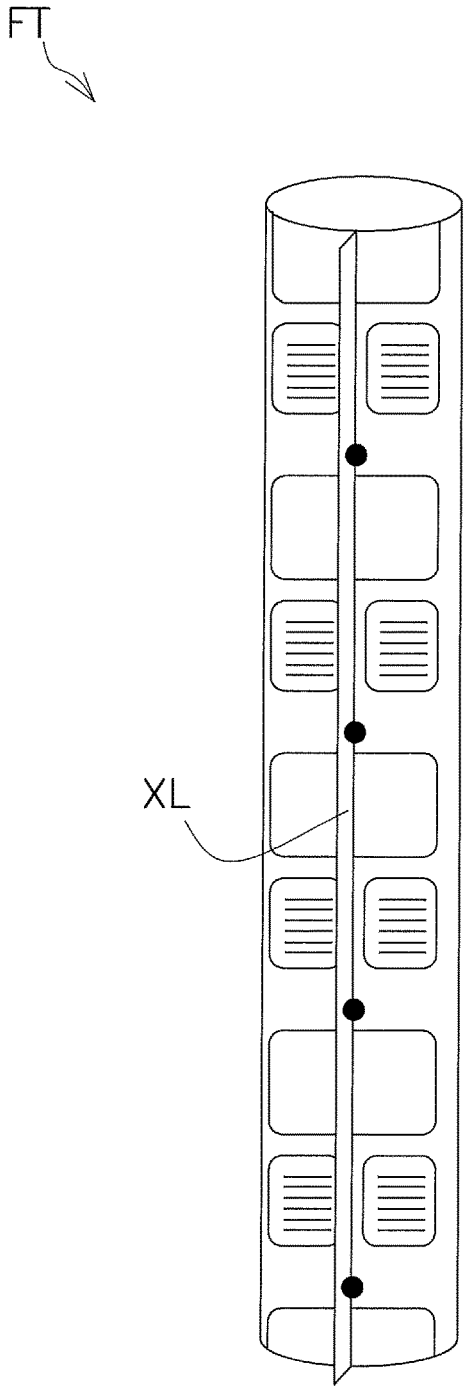
FIG. 5 is a schematic drawing showing a film tube FT.

FIG. 5 shows the film tube FT formed in the longitudinal sealing mechanism 23. The longitudinally sealed part XL is formed in the film tube FT.

Figure 6:
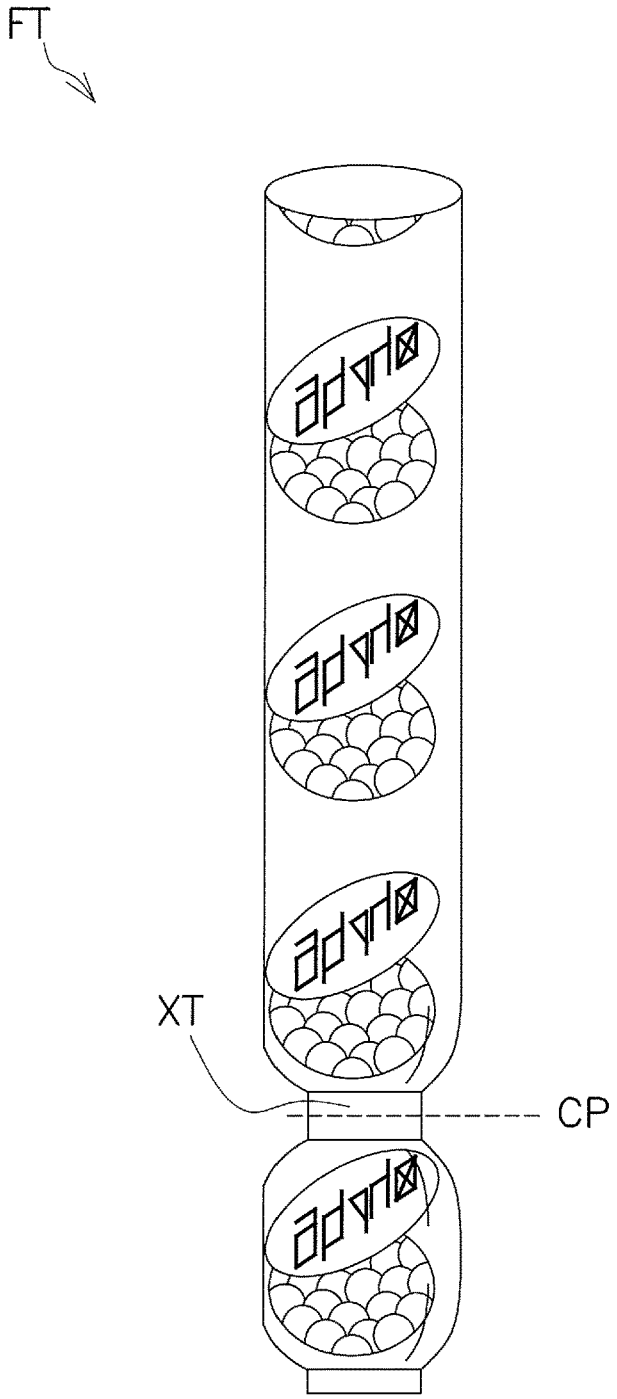
FIG. 6 is a schematic drawing showing a film tube FT.

FIG. 6 shows the transversely sealed part XT formed in the transverse sealing mechanism 24. A cut position CP, where a cut is made by the cutting mechanism 25, is in the transversely sealed part XT.

(4) Basic Operation of Transverse Sealing Mechanism 24

Figure 7:
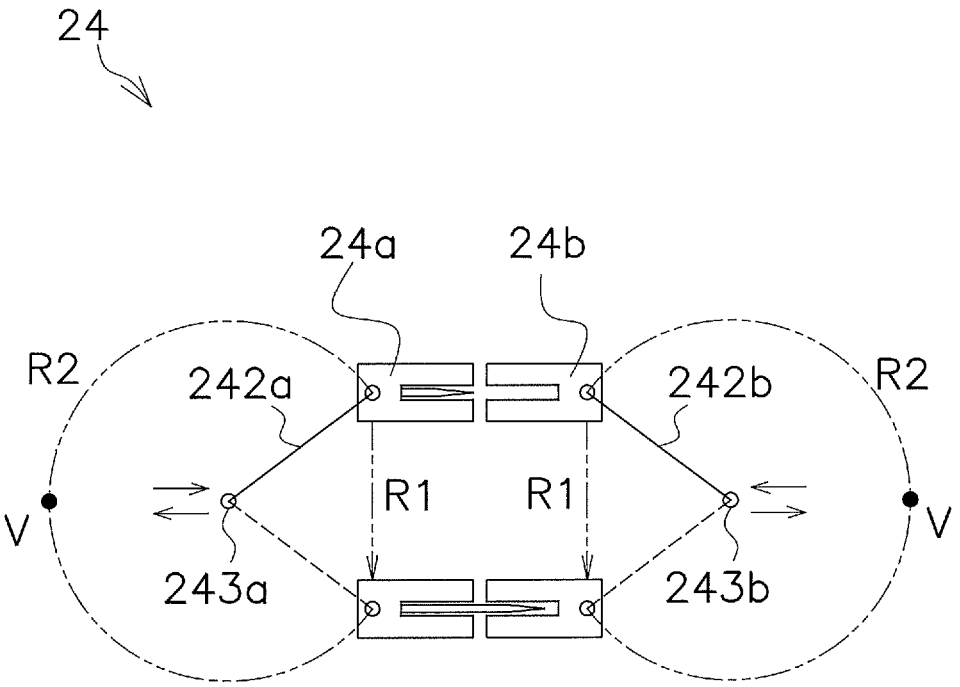
FIG. 7 is a schematic drawing showing a transverse sealing mechanism 24.

FIG. 7 shows the details of the transverse sealing mechanism 24. In addition to the pair of sealing jaws 24*a*, 24*b*, the transverse sealing mechanism 24 has a pair of arms 242*a*, 242*b* and a pair of rotating shafts 243*a*, 243*b*. The pair of arms 242*a*, 242*b* rotate about the respective rotating shafts 243*a*, 243*b*. The rotating shafts 243*a*, 243*b* are able to move horizontally as indicated by the arrows. The movement of the rotating shafts 243*a*, 243*b* is synchronized with the rotation of the arms 242*a*, 242*b*, whereby the sealing jaws 24*a*, 24*b* move in D-shaped paths, indicated by the double-dashed lines. The D-shaped paths each have a straight-line portion R1 and a curved-line portion R2. In the straight-line portions R1, the sealing jaws 24*a*, 24*b* descend at the same speed as the conveying speed of the film F. The transversely sealed part XT is thereby formed. In the final stage of the straight-line portions R1, the cutting mechanism 25 cuts the transversely sealed part XT.

(5) Jamming Countermeasures (5-1) Jamming Prediction

Figure 8:
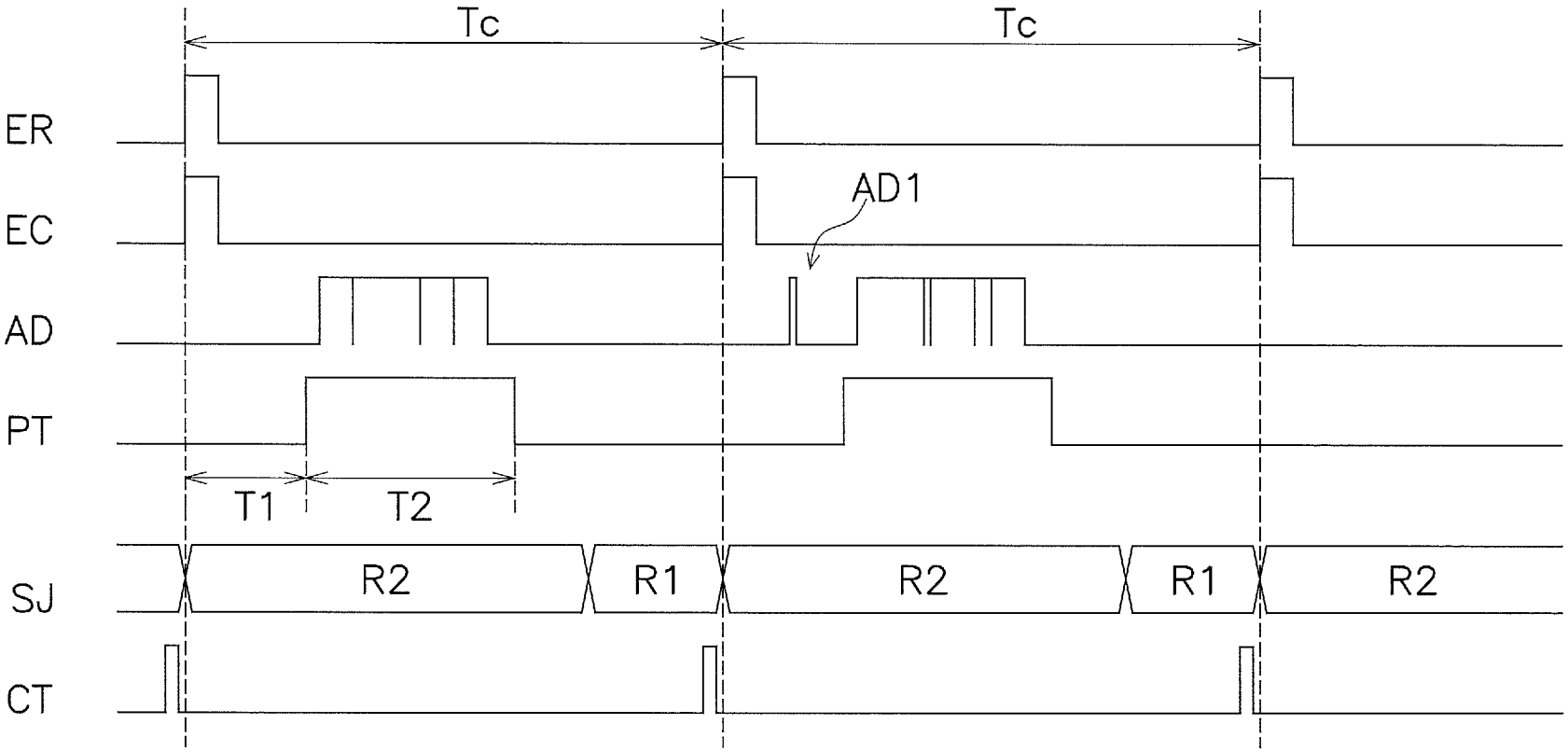
FIG. 8 is a timing chart of various signals of the bag-making and packaging apparatus 20.

FIG. 8 is a timing chart of various signals of the bag-making and packaging apparatus 20. A cycle time Tc is the length of the cycle during which the bag-making and packaging apparatus 20 creates one product P. An ejection request signal ER is a signal from the bag-making and packaging apparatus 20 to the weighing machine 10 to eject articles A, and is generated once per cycle. In one example, the ejection request signal ER is treated as a starting point of the cycle, but the cycle starting point is not limited to this example. An ejection completion signal EC is a signal that reports to the bag-making and packaging apparatus 20 that the weighing machine 10 has ejected articles A in response to the ejection request signal ER. An article detection signal AD is a signal representing detection of falling articles A by the article sensor 26.

A permission time signal PT indicates the timing during which articles A are permitted to pass by the location of the article sensor 26. The waveform of the permission time signal PT is determined by two parameters. The first is an offset time T1. The second is a permission time T2. The offset time T1 begins at the starting point of the operation cycle. The permission time T2 begins at the ending point of the offset time T1. The offset time T1 and the permission time T2 are set so that the sum thereof is shorter than the cycle time Tc. These parameters are stored in the jamming setting storage unit 112 of the processing unit 27.

A sealing jaw state SJ represents the sealing jaws 24*a*, 24*b* as being either in the straight-line portions R1 or the curved-line portions R2. A cut signal CT causes the cutting mechanism 25 to cut the transversely sealed part XT.

When articles A are detected by the article sensor 26 while the permission time signal PT is at a high level, the jamming prediction unit 113 regards the articles A as falling at the proper fall timing. When articles A are detected by the article sensor 26 while the permission time signal PT is at a low level, the jamming prediction unit 113 predicts that the articles A could cause jamming. For example, the jamming prediction unit 113 predicts the occurrence of jamming in that cycle on the basis of the presence of a pulse AD1 in the article detection signal AD.

(5-2) Operation During Jamming Prediction (Cutting Stops)

In a certain cycle, when the jamming prediction unit 113 predicts the occurrence of jamming, the transverse sealing mechanism control unit 124 stops the cutting mechanism 25 in that cycle. The transversely sealed part XT is thereby not cut in that cycle.

(5-3) Ejected Unsatisfactory Product Q

Figure 9:
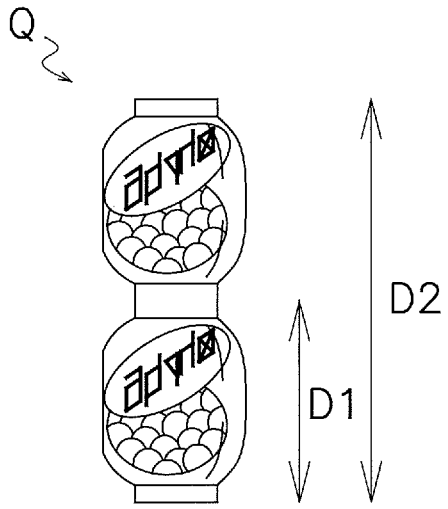
FIG. 9 is a schematic drawing showing an example of an ejected unsatisfactory product Q.

Due to the stopping of the cutting mechanism 25, the bag-making and packaging apparatus 20 ejects an unsatisfactory product Q of the products P. An unsatisfactory product Q is two bags B joined at the transversely sealed part XT, as shown in FIG. 9. A second length D2, which is the length of the unsatisfactory product Q, is longer than a first length D1, which is the length of a product P.

(6) Characteristics (6-1)

In a cycle in which jamming could occur, the cutting mechanism 25 does not cut the film tube FT. Therefore, instances of articles A coming out through the cut position CP of the film tube FT are minimized.

(6-2)

When articles A are detected outside of the permission time T2, the jamming prediction unit 113 predicts that jamming could occur. Therefore, the possibility of jamming is assessed by a simple configuration that uses the article sensor 26.

(6-3)

In a case in which jamming could occur, the bag-making and packaging apparatus 20 creates a bag that is longer than the length of a product P. Therefore, it is easy to identify an unsatisfactory product Q including a spot where jamming has occurred.

(7) Modifications

Modifications of the above embodiment are presented below. A plurality of modifications can be combined.

(7-1) Operation During Jamming Prediction (Transverse Sealing Operation Stopped)

In the above embodiment, when the jamming prediction unit 113 predicts the occurrence of jamming, the transverse sealing mechanism control unit 124 stops the cutting mechanism 25 in that cycle. In addition, the transverse sealing mechanism control unit 124 can stop the transverse sealing mechanism 24 in that cycle.

Specifically, the transverse sealing mechanism control unit 124 stops the sealing jaws 24*a*, 24*b* at points V in the curved-line portions R2 of the D-shaped paths in FIG. 7. The sealing jaws 24*a*, 24*b* thereby do not come into contact with the film tube FT in that cycle.

Figure 10:
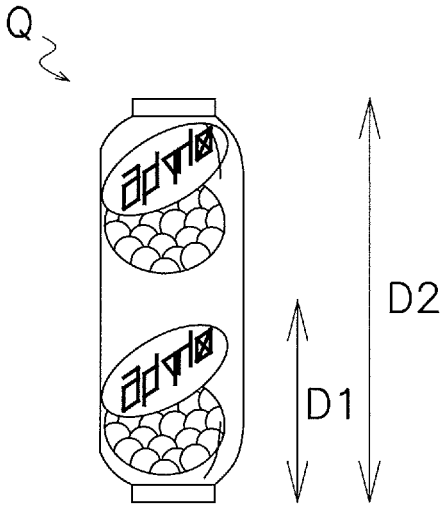
FIG. 10 is a schematic drawing showing an example of an ejected unsatisfactory product Q.

The ejected unsatisfactory product Q is two joined bags B with no transversely sealed part XT, as shown in FIG. 10.

With this configuration, the transverse sealing mechanism 24 does not form a transversely sealed part XT in the film tube FT in a cycle in which jamming could occur. Therefore, damage to the film F by the transverse sealing operation is minimized, and instances of articles A coming out from the film tube FT are therefore further minimized.

(7-2) Jamming Sensing Unit

Figure 11:
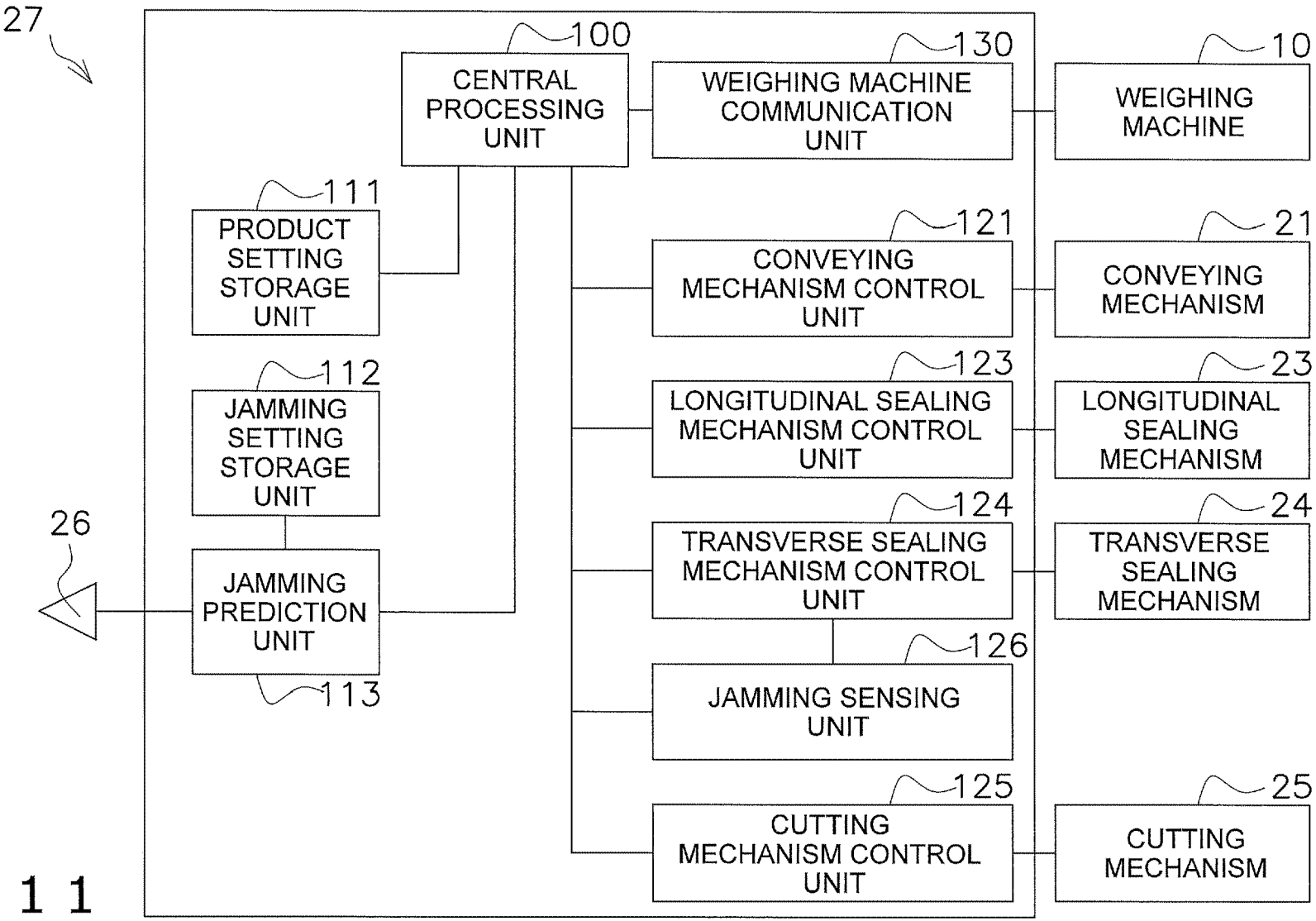
FIG. 11 is a block diagram of the processing unit 27 of the bag-making and packaging apparatus 20 according to a modification of the present disclosure.

The transverse sealing mechanism 24 can further have a jamming sensing unit 126 that senses an actual determination of jamming, as shown in FIG. 11. The jamming sensing unit 126 is configured as, for example, an electric current monitoring unit that monitors electric currents of motors that drive the arms 242*a*, 242*b* of the transverse sealing mechanism 24. In this case, when an electric current exceeding a predetermined threshold value flows to a motor, the jamming sensing unit 126 assesses that jamming is occurring.

Furthermore, when the jamming sensing unit 126 does not sense jamming, the central processing unit 100 can update the length of the permission time T2 to a length increased by a predetermined amount, and can write the updated length into the jamming setting storage unit 112.

With this configuration, the permission time T2 is extended when the jamming sensing unit 126 does not actually sense jamming. Therefore, the permission time T2 is automatically optimized.

(7-3) Warning Unit

Figure 12:
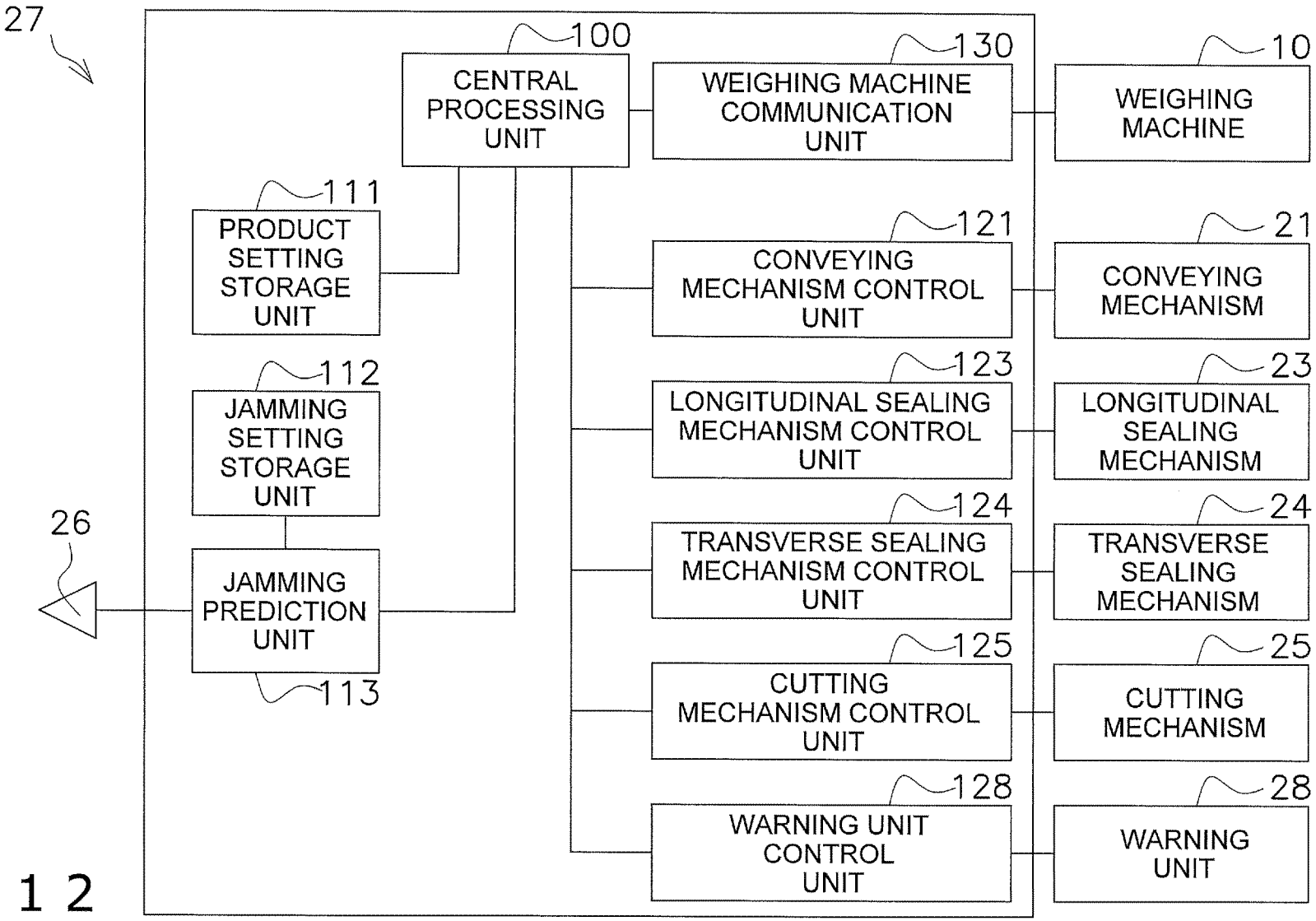
FIG. 12 is a block diagram of the processing unit 27 of the bag-making and packaging apparatus 20 according to another modification of the present disclosure.

As shown in FIG. 12, the bag-making and packaging apparatus 20 can be further provided with a warning unit 28 that issues a warning when the jamming has occurred at least a predetermined number of times within a predetermined time duration.

With this configuration, a warning is issued when the frequency of jamming occurrences is high. Therefore, the user has an opportunity to reexamine the set value of the permission time T2.

(7-4) Structure of Transverse Sealing Mechanism 24

In the above embodiment, the sealing jaws 24*a*, 24*b* of the transverse sealing mechanism 24 move through the D-shaped paths in FIG. 7. As an alternative, the sealing jaws 24*a*, 24*b* can move horizontally back and forth.

With this configuration, the structure of the transverse sealing mechanism 24 is simple.

(7-5) Structure of Cutting Mechanism 25

In the above embodiment, the cutting mechanism 25 cuts the transversely sealed part XT with the knife 25*a*. As an alternative, the cutting mechanism 25 can be configured to thermally cut the transversely sealed part XT with the heat of the heaters of the sealing jaws 24*a*, 24*b*.

With this configuration, there are few mechanical components, which is advantageous from the standpoint of the maintenance of the bag-making and packaging apparatus 20.

REFERENCE SIGNS LIST

10 Weighing machine
20 Bag-making and packaging apparatus
21 Conveying mechanism
22 Film-shaping mechanism
22*a* Former
22*b* Tube
23 Longitudinal sealing mechanism
24 Transverse sealing mechanism
25 Cutting mechanism
26 Article sensor
27 Processing unit
100 Central processing unit
111 Product setting storage unit
112 Jamming setting storage unit
113 Jamming prediction unit
A Articles
AD Article detection signal
B Bag
CP Cut position
CT Cut signal
EC Ejection completion signal
ER Ejection request signal
F Film
FR Film roll
FT Film tube
P Product
PT Permission time signal
R1 Straight-line portion
R2 Curved-line portion
T1 Offset time
T2 Permission time
Tc Cycle time
XL Longitudinally sealed part
XT Transversely sealed part

The invention claimed is:

1. A bag-making and packaging apparatus that creates one product per cycle by packaging articles falling from a weighing machine in a bag made from a film, the bag-making and packaging apparatus comprising:

a longitudinal sealing mechanism that forms a film tube from the film;

a guide that guides the articles which fall from the weighing machine into the film tube;

an article sensor disposed at a location below the weighing machine, the article sensor configured to sense the articles which fall from the weighing machine;

a transverse sealing mechanism that forms a transversely sealed part in the film tube with each cycle;

a cutting mechanism that cuts the film tube in the transversely sealed part with each cycle; and a prediction unit that predicts whether or not jamming of the articles occurs in the transverse sealing mechanism based on a fall timing of each of the articles which falls from the weighing machine to pass by the location of the article sensor with each cycle, wherein when the prediction unit has predicted that the jamming occurs in a certain cycle, the cutting mechanism does not cut the film tube in the certain cycle.

2. The bag-making and packaging apparatus according to claim 1, wherein when the prediction unit has predicted that the jamming occurs in the certain cycle, the transverse sealing mechanism does not form the transversely sealed part in the certain cycle.

3. The bag-making and packaging apparatus according to claim 1, further comprising:

a setting storage unit that stores an offset time beginning at the starting point of the cycle and a permission time beginning at the ending point of the offset time, wherein a sum of the offset time and the permission time is shorter than the cycle, and when the article sensor detects the articles outside of the permission time, the prediction unit predicts that the jamming occurs.

4. The bag-making and packaging apparatus according to claim 3, further comprising:

a processing unit; and a jamming sensing unit that senses an occurrence of the jamming;

wherein when the jamming sensing unit does not sense an occurrence of the jamming, the processing unit updates the permission time stored by the setting storage unit to a longer time.

5. The bag-making and packaging apparatus according to claim 1, further comprising:

a warning unit that issues a warning when the jamming has occurred at least a predetermined number of times within a predetermined time duration.

6. The bag-making and packaging apparatus according to claim 1, wherein the length of the bag of the product is a first length, and when the prediction unit has predicted that the jamming occurs, a second bag having a second length greater than the first length is created due to the cutting mechanism not cutting the film tube.

* * * * *